United States Patent [19]

Bollmer

[11] 4,092,923

[45] June 6, 1978

[54] PRINTING BLANKET HOLDING APPARATUS

[75] Inventor: Jacob A. Bollmer, Dayton, Ohio

[73] Assignee: Dayco Corporation, Dayton, Ohio

[21] Appl. No.: 773,239

[22] Filed: Mar. 1, 1977

[51] Int. Cl.[2] ..... B41F 27/12

[52] U.S. Cl. ..... 101/415.1; 101/385; 269/235

[58] Field of Search ..... 269/235; 101/415.1, 101/383 R-386, 394, 127.1, 128.1

[56] References Cited

U.S. PATENT DOCUMENTS

| | | | |
|---|---|---|---|
| 406,828 | 7/1889 | Fietsch, Jr. | 101/385 |
| 724,116 | 3/1903 | Maley | 101/385 |
| 810,067 | 1/1906 | Maley | 101/385 |
| 1,957,107 | 5/1934 | Merriam | 101/386 |
| 2,782,819 | 2/1957 | Levy, Jr. | 269/235 |

FOREIGN PATENT DOCUMENTS

| | | | |
|---|---|---|---|
| 2,252,949 | 5/1973 | Germany | 101/415.1 |
| 555,411 | 7/1932 | Germany | 101/415.1 |
| 1,184,855 | 3/1970 | United Kingdom | 101/415.1 |

*Primary Examiner*—William Pieprz
*Attorney, Agent, or Firm*—Reuben Wolk

[57] ABSTRACT

Apparatus for holding an end portion of a printing blanket on an associated printing cylinder is provided and employs an elongate holding bar and bar support which cooperate to hold such end portion in position in a highly efficient manner and the apparatus has double eccentric means for quickly attaching and detaching the holding bar relative to the bar support.

14 Claims, 6 Drawing Figures

PRINTING BLANKET HOLDING APPARATUS

BACKGROUND OF THE INVENTION

Offset printing presses of the type used in lithographic printing usually employ printing blanket each fastened around the periphery of an associated printing roll or cylinder, for the purpose of picking up an ink design or image deposited thereon by an inking roller or master for transfer onto an article being printed, such as paper, or the like. Each printing blanket is held on its associated cylinder by fastening opposite end portions of the blanket thereagainst using various techniques. For example, in some applications the leading end portion of the blanket is suitably fixed to a holding bar which is detachably mounted on the cylinder whereupon the printing blanket is wrapped around such cylinder and the trailing end portion, which is also fixed to a holding bar, is then also suitably detachably fastened in position on the cylinder employing a rotatable reel like mechanism which is often popularly referred to as a reel rod. In some applications the leading end portion of the blanket is also fastened on the cylinder using a reel rod. However, a problem with printing blanket holding apparatus proposed heretofore is that such apparatus do not provide a high strength and efficient means for attaching and detaching the blanket holding bar relative to an associated bar support.

SUMMARY

It is a feature of this invention to provide a simple and economical apparatus for holding an end portion of a printing blanket against an associated cylinder.

Another feature of this invention is to provide an apparatus of the character mentioned which is quickly and easily operated.

Another feature of this invention is to provide an apparatus of the character mentioned which employs double eccentric means which is easily installed on existing printing cylinders with minimum modification thereof.

Another feature of this invention is to provide apparatus for holding an end portion of a printing blanket on an associated printing cylinder wherein such apparatus employs an elongate holding bar and a bar support which cooperate to provide a high strength holding action and wherein such apparatus includes double eccentric means for quickly attaching and detaching the holding bar relative to the bar support.

Accordingly, it is an object of this invention to provide a printing blanket holding apparatus having one or more of the novel features set forth above or hereinafter shown or described.

Other details, features, objects, uses, and advantages of this invention will become apparent from the embodiments thereof presented in the accompanying specification, claims, and drawing.

BRIEF DESCRIPTION OF THE DRAWING

The accompanying drawing shows present preferred embodiments of this invention, in which.

DESCRIPTION OF ILLUSTRATED EMBODIMENT

Figure 1:
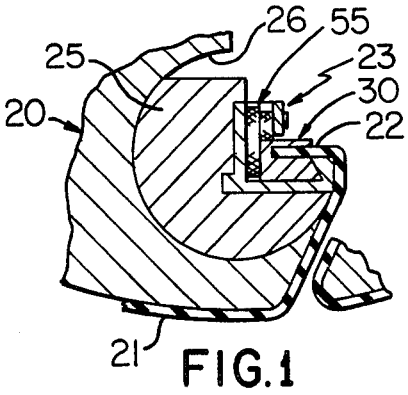
FIG. 1 is a fragmentary cross-sectional end view of a portion of a printing cylinder showing a trailing end portion of a printing blanket held in position thereon by holding apparatus of this invention.

Reference is now made to FIG. 1 of the drawing which illustrates a fragmentary portion of an exemplary printing press cylinder 20 which is particularly adapted to be installed in a printing press of known construction and the printing cylinder 20 has a printing blanket 21 suitably disposed therearound and held tautly in position in a manner as is well known in the art. The blanket 21 has a leading end portion (not shown) which is suitably detachably fastened to the cylinder 20 and a trailing end portion 22 which is detachably fastened in position on the cylinder 20 employing holding apparatus of this invention which is designated generally by the reference numeral 23. The exemplary cylinder 20 has a so-called reel rod 25 suitably supported for rotation within a cylindrical recess 26 of the cylinder and the holding apparatus 23 is provided on the reel rod 25 and in this example holds the trailing end of the printing blanket 21 on the cylinder 20. In some printing presses, cylinders having so-called double reel rods are used whereby the apparatus 23 of this invention is preferably used to fasten both the leading end portion and the trailing end portion of a printing blanket in position thereon.

Figure 3:
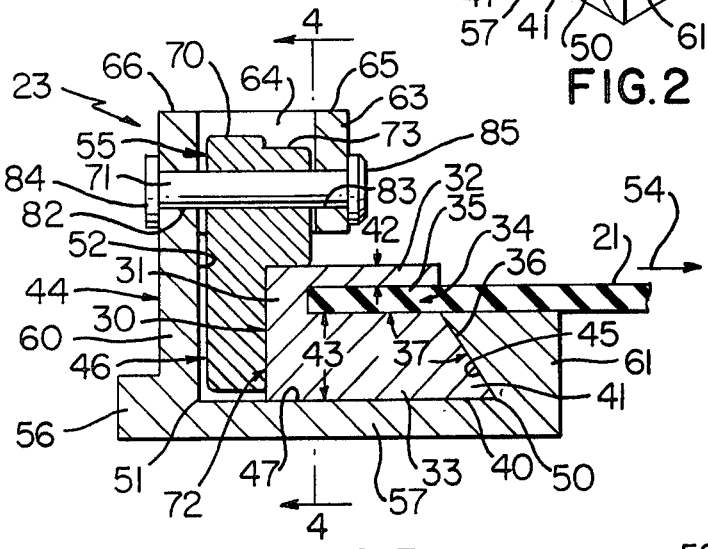
FIG. 3 is a cross-sectional view taken essentially on the line 3—3 of FIG. 2.

As will be seen from FIG. 3 of the drawing the apparatus comprises an elongate holding bar 30 of roughly U-shaped cross-sectional outline having a bight 31 and a pair of legs 32 and 33 extending from opposite ends of the bight 31 with the legs 32 and 33 defining a channel 34 therewithin for receiving an end portion 35 of the printing blanket 21 therewithin. The leg 33 has an inclined cam surface 36 which comprises a terminal end portion thereof and such cam surface is disposed at an obtuse angle 37 to the end portion 35 of the blanket in the channel 34. The leg 33 also has a surface 40 arranged parallel to the end portion 35 and the parallel surface 40 and inclined cam surface 36 define a wedge-like portion 41 of the leg 33.

The legs 32 and 33 are disposed in parallel relation from opposite ends of the bight 31 and the leg 32 has a thickness 42 which is substantially less than the comparatively large thickness 43 of the leg 33. The end portion 35 of the blanket 21 is clamped in position between the legs 32 and 33 utilizing any suitable technique known in the art and such technique may comprise suitable mechanical projections extending from one or both of the legs 32-33, adhesive means, or the like.

The holding apparatus 23 comprises a blanket holding bar adapter which is referred to herein as a bar support 44 and such support is adapted to be suitably detachably fixed to the reel rod or reel 25 utilizing any suitable technique known in the art including, for example, mechanical screws, bolts, pins, or the like. The bar support 44 is adapted to receive the holding bar 30 therewithin and such bar support has a cooperating surface 45 for receiving the cam surface 36 thereagainst. The apparatus 23 also has double eccentric means, to be subsequently described, for attaching and detaching the holding bar 30 and hence trailing end portion 35 of blanket 21 relative to the bar support 44.

The bar support 44 has a channel or space 46 therein for receiving the holding bar 30 and the space is defined by a bottom surface 47 having opposite side edges 50 and 51 with the cooperating surface 45 adjoining one of the edges, i.e., the edge 50, and another surface 52 adjoining the other edge 51. As will be readily apparent from FIG. 3 of the drawing the cooperating surface 45 is disposed at an inclined angle to the bottom surface 47 with such inclined angle corresponding to the angle of the inclined cam surface 36. Further, the surface 52 is disposed substantially perpendicular to the bottom surface 47.

The cam surface 36 of leg 33 serves to thrust the wedge-like portion 41 in locked engagement between the cooperating surface 45 and the bottom surface 47 once pulling forces are applied by the blanket 21 parallel to its end portion 45 and such pulling forces are represented schematically by a force arrow 54.

As mentioned earlier, the holding apparatus 23 has double eccentric means for attaching and detaching the holding bar relative to the bar support 44 and such double eccentric means is designated generally by the reference numeral 55. The double eccentric means is adapted to be operated easily and quickly and such double eccentric means will be described in more detail subsequently.

Figure 2:
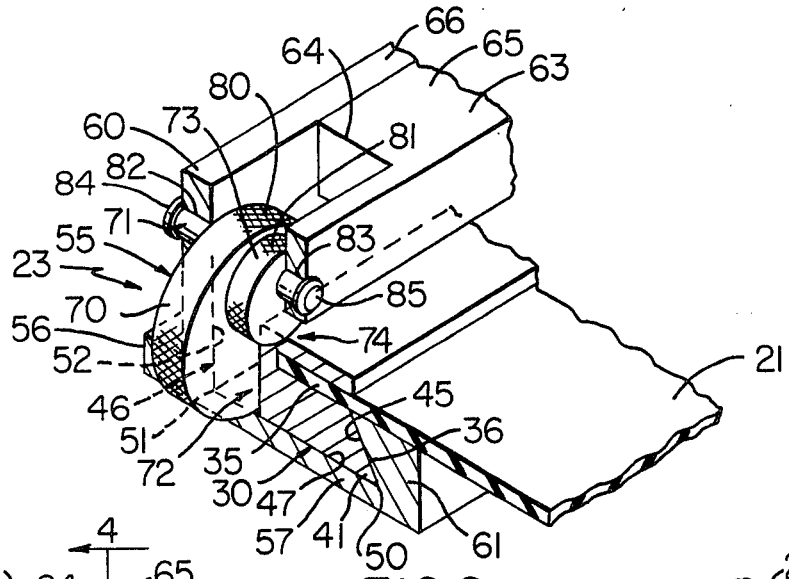
FIG. 2 is a perspective view with parts in cross section and parts broken away illustrating the printing blanket holding apparatus of this invention.
Figure 4:
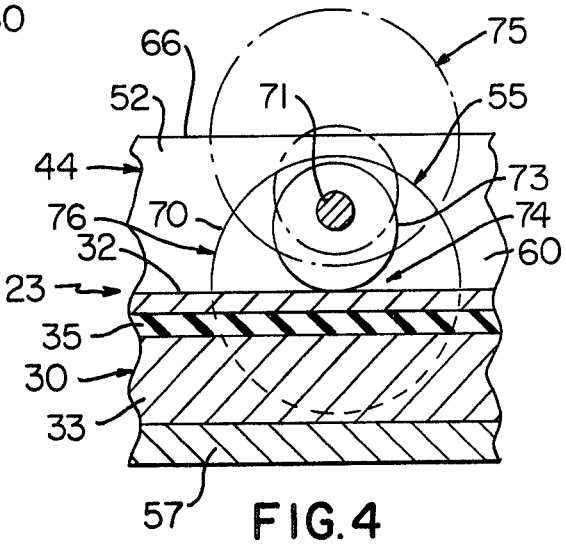
FIG. 4 is a view taken essentially on the line 4—4 of FIG. 3 and by dot-dash lines illustrating double eccentric means of the apparatus rotated out of locking engagement.

The bar support 44 of FIGS. 2, 3, and 4 is shown as a two piece support wherein one of the pieces is a substantially L-shaped component designated generally by the reference numeral 56 and having a leg 57 and a leg 60 disposed transverse thereto. The leg 57 has a transverse projection 61 extending from its terminal end and the transverse projection 61 has a cooperating surface 45 defined as its inside surface. The leg 57 also has the previously described bottom surface 47 defined as its inside surface. In a similar manner the leg 60 extends perpendicularly from the leg 57 and has the previously described surface 52 defined as its inside surface.

The bar support 44 also has a separate member 63 suitably fixed to the top portion thereof and member 63 has spaced cutouts 64 therealong which are particularly adapted to receive the double eccentric means 55 therewithin. The member 63 is suitably fixed in position at the top portion of the leg 60 so that a top surface 65 thereof is disposed substantially coplanar with a top surface 66 of the leg 60. Thus, it will be seen that the bar support 44 is in essence a two-piece support comprised of the L-shaped member 56 and top member 63.

The double eccentric means 55 comprises a comparatively large diameter first circular disc 70 eccentrically mounted on the bar support 44 by a support shaft 71 disposed in spaced relation from the central axis of the first disc 70; and, as will be apparent from FIG. 2 of the drawing the first disc 70 is adapted to hold the wedge-like portion 41 in locked engagement between the cooperating surface 45 and the bottom surface 47 and as shown at 72.

The double eccentric means 55 also comprises a second disc 73 having a smaller diameter than the first disc 70 and the second disc 73 is also eccentrically mounted on the support shaft 71 with such support shaft 71 also being disposed in spaced relation from the central axis through the second disc 73. The disc 73 serves to clamp the holding bar 30 against the bottom surface 47 with clamping engagement being provided by the disc 73 engaging an outside surface of leg 32 of the holding bar 30, as shown as at 74 in FIG. 4.

The double eccentric means 55 provides quick and easy means for efficiently installing the holding bar 30 on the bar support 44. For example, the holding bar 30 may be quickly installed in position by rotating the double eccentric means out of locking relation, essentially as shown at 75 in FIG. 4. Once the holding bar 30 is installed in position the double eccentric means 55 is rotated about shaft 71 to the position illustrated at 76 in FIG. 4 (which is the position illustrated in FIG. 3) to thereby provide a dual holding action. The dual holding action is defined by locking the wedge-like portion 41 in locked engagement between surfaces 45 and 47 and clamping the holding bar against the surface 47. The locking action is provided by the disc 70 and the clamping action is provided by the disc 73.

The double eccentric means 55 illustrated in FIG. 3 is defined by the disc 70 and disc 73 made as a single-piece structure and carried on support shaft 71. Further, the discs 70 and 73 have knurled surfaces 80 and 81 respectively defined thereon, see FIG. 2, and such surfaces 80 and 81 facilitate grasping and rotation of discs 70 and 73 with surface 81 also providing greater frictional engagement against the holding bar 30.

The discs 70 and 73 of the double eccentric means 55 are suitably rotatably mounted on the bar support 44 and in this example of the invention the discs 70 and 73 are preferably fixed to the shaft 71 using any suitable technique and the shaft 71 is rotatably mounted on the bar support 44. In particular, it will be seen that opposite end portions of the shaft 71 extend through cooperating axially aligned openings 82 and 83 provided in leg 60 and member 63 respectively. The supporting surfaces for the opposite end portions of the shaft 71 are defined by right circular cylindrical surfaces defining the openings 82 and 83.

The shaft 71 is a rivet-like shaft having an enlarged head portion or head 84 at one end of the shaft 71 and a disc-like enlargement 85 at the opposite end of the shaft 71. The enlargement 85 may be defined by deforming an extended part at the opposite end of the shaft 71 to define the enlargement 85 or such enlargement may be defined by suitably fixing a head-like part to such opposite end. The enlargement 85 may be in the form of a threaded nut.

The discs 70 and 73 of eccentric means 55 need not necessarily be fixed to the shaft 71 for rotation therewith. The shaft 71 may be fixed in position and the discs 70 and 73 may be rotatable relative thereto.

Figure 5:
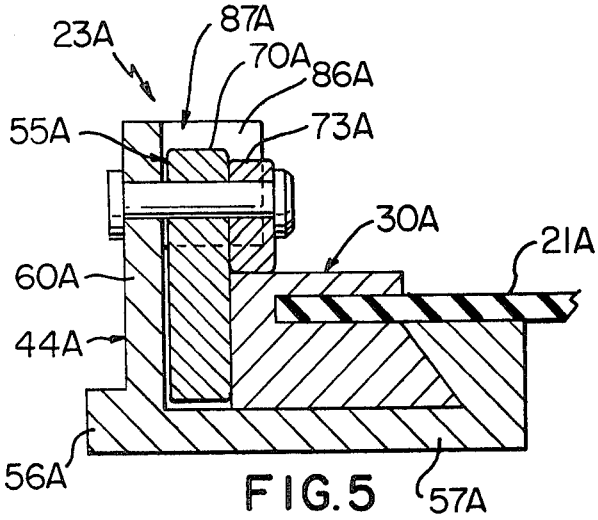
FIG. 5 is a view similar to FIG. 3 illustrating another exemplary embodiment of the holding apparatus of this invention.

Another exemplary embodiment of the holding apparatus of this invention is illustrated in FIG. 5 of the drawing. The holding apparatus illustrated in FIG. 5 is very similar to the holding apparatus 23; therefore, such holding apparatus will be designated generally by the numeral 23A and parts of the apparatus 23A which are very similar to corresponding parts of the apparatus 23 will be designated by the same reference numerals as in the apparatus 23 also followed by the letter designation "A" and not described again in detail.

The main differences between the apparatus 23A and the apparatus 23 are that the apparatus 23A instead of having a single-piece structure defining the double eccentric means 55 employs two separate discs 70A and 73A defining such double eccentric means 55A. In addition, instead of the bar support 44A being defined as two separate pieces such bar support is defined as a single L-shaped piece 44A having a lower leg 57A and an upper projection 86A extending from an outer portion of its leg 60A with the projection 86A being defined as an integral part of the leg 60A and being provided with a suitable cutout 87A for receiving associated discs 70A and 73A therewithin.

Figure 6:
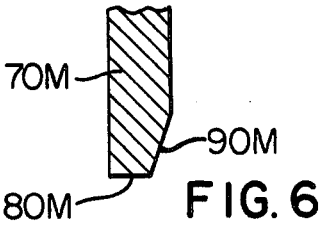
FIG. 6 is a cross-sectional view of the lower portion of a modification of a comparatively large diameter disc which may comprise either exemplary embodiment of the double eccentric means of the holding apparatus of this invention.

Reference is now made to FIG. 6 of the drawing which illustrates a modification of a lower portion of a comparatively large diameter disc 70M which may comprise either exemplary embodiment of the double eccentric means of the holding apparatus of this invention. The disc 70M is similar to the discs 70 and 70A. The only difference between the disc 70M and the discs 70 and 70A is that the disc 70M has a frustoconical inclined surface 90M adjoining its right circular cylindrical knurled surface 80M. The inclined surface 90M serves as a cam surface or wedge and helps thrust its associated holding bar forwardly within its bar support in the event such associated holding bar is not firmly seated, i.e., is partially seated, in the bar support. For example, in making the disc 70M as a part of the double eccentric means 55 of the holding apparatus 23 of FIG. 3 the surface 90M would (upon rotating disc 70M from the position 75 to the position 76 of FIG. 4) engage a partially seated holding bar 30 and help to initially urge wedge-like portion 41 of such holding bar within the confining space defined by surfaces 45 and 47 of leg 57 of the bar support 44.

In this disclosure of the invention, the exemplary apparatus 23 is shown as being suitably fixed in a reel rod 25 of a printing cylinder 20; however, it will be appreciated that each holding apparatus 23 and 23A of this invention may be used as desired and each need not necessarily be fixed to a reel rod because each apparatus may be used in applications in which a reel rod is not employed. Further, each apparatus 23 and 23A of this invention may be used to hold not only the trailing end portion of a blanket in position but also the leading end portion, if desired, and, may be used in a printing cylinder having a so-called double reel rod.

The printing blanket has been illustrated by cross hatching in the drawings of this disclosure as being made of rubber; however, it will be appreciated that this has been done for ease of presentation and it is to be understood that the blanket may be made using suitable known materials and such blanket may be suitably reinforced utilizing materials and techniques which are known in the art.

In this disclosure of the invention only one quick attaching means is shown on each bar support; however, it will be appreciated that in actual practice a plurality of such attaching means is preferably employed along an associated bar support to detachably fasten the blanket holding bar in position.

While present exemplary embodiments of this invention, and methods of practicing the same, have been illustrated and described, it will be recognized that this invention may be otherwise variously embodied and practiced within the scope of the following claims.

What is claimed is:

1. Apparatus for holding an end portion of a printing blanket on an associated cylinder comprising; an elongate holding bar of roughly U-shaped cross-sectional outline having a pair of legs defining a groove for receiving said end portion of said blanket therewithin and having an inclined cam surface comprising a terminal end portion of one of said legs; a bar support adapted to be installed on said cylinder and receiving said holding bar therewithin with said bar support having a cooperating supporting surface for receiving said cam surface thereagainst; and double eccentric means for attaching and detaching said holding bar relative to said bar support; said double eccentric means comprising, a support shaft carried by said bar support, a comparatively large first disc eccentrically mounted on said shaft providing locking action for retaining said cam surface against said supporting surface, and a second disc smaller than said first disc and being also eccentrically mounted on said shaft providing clamping action of said bar within said bar support perpendicular to said locking action, said discs being rotatable to enable attaching and detaching of said holding bar.

2. Apparatus as set forth in claim 1 in which said inclined cam surface is disposed at an obtuse angle to said end portion of said blanket in said channel, said one leg has a surface arranged parallel to said end portion, and said parallel surface and inclined surface define a wedge-like portion of said one leg.

3. Apparatus as set forth in claim 2 in which said bar support has a channel therein for receiving said holding bar, said channel being defined by a bottom surface having opposite side edges with said cooperating surface adjoining one of said edges and another surface adjoining the other of said edges, said cooperating surface being disposed at an inclined angle to said bottom surface corresponding to the angle of said inclined cam surface, said other surface being disposed substantially perpendicular to said bottom surface, and said cam surface serving to thrust said wedge-like portion in locked engagement between said cooperating surface and bottom surface once pulling forces are applied by said blanket parallel to its end portion.

4. Apparatus as set forth in claim 3 in which said comparatively large first disc is a large diameter circular disc which serves to hold said wedge-like portion in said locked engagement.

5. Apparatus as set forth in claim 4 in which said second disc is a smaller diameter circular disc which serves to clamp said holding bar against said bottom surface.

6. Apparatus as set forth in claim 5 in which said first and second discs are defined as a single-piece structure and carried on said shaft.

7. Apparatus as set forth in claim 5 in which said first and second discs are defined as separate pieces and carried on said shaft.

8. Apparatus as set forth in claim 5 in which said shaft is rotatably mounted on said bar support and said first and second discs are fixed thereto for rotation therewith.

9. Apparatus as set forth in claim 5 in which said shaft is fixed on said bar support and said first and second discs are rotatable relative thereto.

10. Apparatus as set forth in claim 5 in which said shaft has a right circular cylindrical surface disposed between a head at one end and an enlarged head-like portion at its opposite end, said head and head-like portion serving to prevent axial movement of said shaft relative to said bar support.

11. Apparatus as set forth in claim 5 in which said first and second discs have knurled cylindrical surfaces.

12. Apparatus as set forth in claim 5 in which said bar support comprises a plurality of pieces including a member fixed to a top portion of said bar support, said member having a cutout therein for receiving said double eccentric means therewithin.

13. Apparatus as set forth in claim 5 in which said bar support comprises a single-piece roughly L-shaped construction having a projection extending from an outer portion thereof on one of its legs and a cutout in said projection for receiving said double eccentric means therewithin.

14. Apparatus as set forth in claim 5 in which said first disc has a frustoconical inclined surface thereon which is adapted to serve as a cam which also helps thrust said holding bar between said cooperating surface and bottom surface during rotation of said double eccentric means to help provide said locked engagement.

* * * * *